United States Patent [19]

Kanakis

[11] 3,979,837

[45] Sept. 14, 1976

[54] FOLIAGE AND FLORAL PRESERVATION AND MATERIAL THEREFOR

[76] Inventor: Dorothy M. Kanakis, 7008 Cliffbrook, Dallas, Tex. 75240

[22] Filed: Apr. 1, 1975

[21] Appl. No.: 563,961

[52] U.S. Cl. ..... 34/9; 34/71; 34/95

[51] Int. Cl.[2] ..... F26B 5/16

[58] Field of Search ..... 34/9, 71, 95, DIG. 1

[56] References Cited

UNITED STATES PATENTS

| | | | |
|---|---|---|---|
| 1,247,284 | 11/1917 | Kruger | 34/71 |
| 1,750,498 | 3/1930 | Truax | 34/9 |
| 2,185,129 | 12/1939 | Maus | 34/9 |
| 2,906,636 | 9/1959 | Hoivik | 34/9 |
| 3,571,942 | 3/1971 | Orensten et al. | 34/9 |

*Primary Examiner*—John J. Camby

*Attorney, Agent, or Firm*—Warren H. Kintzinger

[57] ABSTRACT

Fresh cut flowers and foliage are preserved by drying with a material composed of ground, harvested crop residues sprayed with oil.

8 Claims, No Drawings

FOLIAGE AND FLORAL PRESERVATION AND MATERIAL THEREFOR

This invention relates to a method for the preservation of fresh cut flowers and foliage, and to the materials therefor.

The art of preserving fresh cut flowers and foliage by drying, to retain the color and shape of the original, goes back many years. Aesthetically arranged dried flowers and foliage provides artistic decorations for use in the home, and in the office and sundry other business establishments. The oldest drying technique is hanging flowers upside down for a few weeks in a dark dry place. A more recent technique involves surrounding the flowers with a desiccant material capable of absorbing all of the plant's moisture. For this purpose, many desiccant materials have been tried, with varying degrees of success. For example, household borax is used-but borax has the disadvantage of incomplete coverage of the flower's surface. The most often used desiccant material is silica gel, a fine sand-like powder that thoroughly covers the flower. There are a number of disadvantages with the use of silica gel, too: When the flowers have dried, removing them from this desiccant material around them is a very delicate procedure, for they become extremely brittle. Also, silica gel is of such density that it tends to break off parts of the flower, necessitating either adhesive reconstruction of the flower, or its disposal. Silica gel is a dusty material; and, in addition to its other disadvantages, long exposure to the dust can deleteriously effect the lungs. The particles of silica gel are hard, with pointed edges that irritate the skin, and pack under the fingernails, and silica gel is relatively expensive.

It is therefore a principal object of this invention to provide a method for preserving fresh cut flowers and foliage by drying.

Another object is to provide a low density desiccant material that will not damage dried flower parts.

A further object is to provide a desiccant material that is not dusty.

A still further object is to provide a desiccant material that is not irritating.

Yet another object is to provide a desiccant material that is not expensive.

Features of the invention useful in accomplishing the above objects include a preservation method utilizing a desiccant material composed of ground, harvested crop residues, sprayed with mineral oil.

In accordance with the principles of this invention, it is found that an agricultural by-product from a harvested crop residue possesses certain characteristics that are extremely advantageous for use as a preservative-without the aforesaid disadvantages of other well known desiccants. Some of these characteristics are as follows: (a) Availability at low cost; (b) cellular structure; (c) low moisture content; (d) resistance to mold and decay; (e) low density; (f) high natural starch content, for moisture absorbability; (g) moisture liberation by oxidation or aeration; (h) reusable; and (i) nontoxic. The particular agricultural residue found to be best is ground rice hulls. In addition to the foregoing characteristics, rice hulls are low in food or feed value, thereby having a very favorable supply/cost relationship.

To be most effective, the rice hulls must be ground to the proper size and must be of the proper moisture content. Before processing, the maximum allowable moisture content is about 25%. After processing, including drying in the oven, the maximum allowable moisture content is 10%. The moisture content that is most desirable is 8%. Then, ground to the proper size, the rice hulls completely surround an embedded flower, and support it. If the hulls are not ground finely enough, they will not completely cover the flower surface-as is the problem with household borax. If the hulls are ground too finely, the material tends to "pack" or "bridge" around the embedded flower. Packing interferes with the aerating process; bridging does not offer the proper support to the embedded flower, and collapse of the bridge causes disfigurement to the drying flower.

For optimum results, an agricultural residue with a bulk density of about 26 to 27 pounds per cubic foot should be reduced in particle size so that about 0.8% is retained on a No. 30 U.S. Standard Screen; about 20%, on a No. 40 U.S. Standard Screen; about 64.2%, on a No. 60 U.S. Standard Screen; about 5.8%, on a No. 80 U.S. Standard Screen; about 2%, on a No. 100 U.S. Standard Screen; and about 7% falls No. 100 U.S. Standard Screen with about 0.2% dust loss. (The foregoing percentages were found after about three minutes vibration on a Rotop machine.)

To keep down the dust generated by the finely ground particles, oil, proportioned to the amount of about 1% of the weight, sprayed on the hulls during the grinding process, solves the dust problem without detracting from any of the desirable characteristics of the material. In particular, it was determined that Exxon No. 3435 process oil, introduced by atomizing the oil at 1,000 p.s.i., in the range of ¾% to 1–½%, by weight, to the ground rice hulls in a screw conveyor-using a pneumatic blower, provided suitable characteristics for the desired use.

Because the properties of agricultural residues differ from those of other desiccants such as silica gel, the preservation techniques also differ. Using silica gel, preservation must take place within a sealed container. An open container is essential, however, when using agricultural residues. The container must be large enough to permit embedment of the flower, with a minimum of one inch clearance from the container walls, and because it is open, any inexpensive household carton, such as cottage cheese cartons, cut-off milk cartons, etc., may be used.

Ground rice hulls are lightweight, thus they do not crush the delicate parts of the flowers. In addition, the cellular structure of rice hulls support the flowers' petals, enabling the flower to maintain its orginal configuration, and, at the same time, permitting aeration. Moisture is transferred from the flower to the desiccant material, due to the low moisture content and natural starches of the rice hulls. Natural resistance to mold and decay is attributable to the proclivity of rice hulls to oxidize this moisture into the atmosphere.

The natural preserving process described above, using ground rice hulls, requires 7 to 10 days. Accelerated preservation can be accomplished by placing the prepared container in an oven and heating it to a temperature in the range of 90° – 110° Fahrenheit for approximately 24 hours. In fact, heating appears to be a required step in the treatment and preserving process of such delicate flowers as orchids, chrysanthemums, bird of paradise, etc.

Although the foregoing discussion concerns ground rice hulls, other ground, harvested, crop residues are effective desiccants. Corncobs, for example, or wheat chaff, may be substituted for the rice hulls.

As a desiccant for flower preservation, the use of ground, harvested, crop residues, in accordance with Applicant's teachings, results in a higher quality finished flower, as well as in a more proficient process that produces far fewer damaged flowers than the heretofore more widely used methods of preservation, such as with silica gel—and these agricultural residuals are not-irritating and non-toxic.

Wherein this invention is herein described with respect to a plurality of embodiments thereof, it should be realized that various changes may be made without departing from the essential contributions to the art made by the teachings hereof.

I claim:

1. A method of preserving a flower blossom comprising the step of embedding said flower blossom, in its natural state, in a container filled with ground rice hulls; said container being open to the atmosphere.

2. The method of claim 1, further including the step of heating said embedded flower blossom for about 24 hours to a temperature within the range of about 90° Fahrenheit to about 105° Fahrenheit.

3. A composition for use as a desiccant for preserving flower blossoms, comprising ground rice hulls and mineral oil.

4. The composition of claim 3, wherein said mineral oil is in the range of about ¾ to 1½%, by weight, of said composition.

5. The composition of claim 3, wherein said rice hulls are particalized such that about 0.8% thereof by weight is retained on a No. 30 U.S. Standard Screen, about 20% thereof is retained on a No. 40 U.S. Standard Screen, about 64.2% thereof is retained on a No. 60 U.S. Standard Screen, about 5.8% thereof is retained on a No. 80 U.S. Standard Screen, about 2% thereof is retained on a No. 100 U.S. Standard Screen, and about 7% thereof falls through said No. 100 U.S. Standard Screen.

6. The composition of claim 5, with said rice hulls, prior to being ground, having a bulk density of about 26 to 27 pounds per cubic foot.

7. The method of claim 1, with said ground rice hulls being particalized such that about 0.8% thereof by weight is retained on a No. 30 U.S. Standard Screen; about 20% thereof is retained on a No. 40 U.S. Standard Screen; about 64.2% thereof is retained on a No. 60 U.S. Standard Screen, about 5.8% thereof is retained on a No. 80 U.S. Standard Screen, about 2% thereof is retained on a No. 100 U.S. Standard Screen, and about 7% thereof falls through said No. 100 U.S. Standard Screen.

8. The method of claim 7, with said rice hulls, prior to being ground, having a bulk density of about 26 to 27 pounds per cubic foot.

* * * * *